US006666741B1

(12) United States Patent
Wilson

(10) Patent No.: US 6,666,741 B1
(45) Date of Patent: Dec. 23, 2003

(54) GOLF BALL NOVELTY ITEM

(76) Inventor: Brad Lee Wilson, 15652 Taylor St., Omaha, NE (US) 68116

( * ) Notice: Subject to any disclaimer, the term of this patent is extended or adjusted under 35 U.S.C. 154(b) by 0 days.

(21) Appl. No.: 10/252,888

(22) Filed: Sep. 23, 2002

(51) Int. Cl.[7] ..... A63H 30/00

(52) U.S. Cl. ..... 446/175; 446/397; 446/409; 472/56; D21/707; 473/423

(58) Field of Search ..... 446/175, 397, 446/409, 404; 472/51, 56, 137; 473/569, 571, 570, 280, 423, 575; 273/460; D21/707, 708, 713, 714

(56) References Cited

U.S. PATENT DOCUMENTS

| | | | | | |
|---|---|---|---|---|---|
| 3,575,559 | A | * | 4/1971 | Tierney | 369/20 |
| 4,095,798 | A | * | 6/1978 | Marple | 473/147 |
| 4,609,197 | A | * | 9/1986 | Vodin | 473/144 |
| 4,702,140 | A | | 10/1987 | Goldfarb | 84/1.01 |
| 5,112,055 | A | * | 5/1992 | Barnhill | 473/199 |
| 5,288,069 | A | * | 2/1994 | Matsumoto | 473/570 |
| 5,322,717 | A | | 6/1994 | Killian | 428/7 |
| 5,375,839 | A | * | 12/1994 | Pagani | 473/570 |
| 5,463,595 | A | | 10/1995 | Rodhall et al. | 367/93 |
| 5,568,452 | A | * | 10/1996 | Kronenberg | 368/262 |
| D376,630 | S | | 12/1996 | Bradford et al. | D21/208 |
| 5,868,633 | A | * | 2/1999 | Keheley | 473/220 |
| 5,886,631 | A | | 3/1999 | Ralph | 340/541 |
| 5,892,446 | A | | 4/1999 | Reich | 340/573.1 |
| 6,016,100 | A | | 1/2000 | Boyd et al. | 340/384.2 |
| D426,278 | S | | 6/2000 | Parrella et al. | D21/794 |
| 6,200,193 | B1 | * | 3/2001 | Nadel | 446/409 |
| 6,227,933 | B1 | * | 5/2001 | Michaud et al. | 446/462 |
| 6,392,541 | B1 | | 5/2002 | Bucher et al. | 340/541 |
| 6,464,602 | B1 | * | 10/2002 | Rottger | 473/571 |
| 6,544,099 | B2 | * | 4/2003 | Shafik | 446/404 |
| 6,572,492 | B2 | * | 6/2003 | Tinsman | 473/353 |

FOREIGN PATENT DOCUMENTS

| | | | | | |
|---|---|---|---|---|---|
| DE | 20214981 | U1 | * | 12/2002 | A63B/57/00 |
| GB | 2103493 | A | * | 2/1993 | A63B/57/00 |
| JP | 10277273 | A | * | 10/1998 | A63H/5/00 |

* cited by examiner

*Primary Examiner*—Derris H. Banks
*Assistant Examiner*—Urszula M Cegielnik
(74) *Attorney, Agent, or Firm*—Thomte, Mazour & Niebergall; Dennis L. Thomte

(57) ABSTRACT

A golf ball novelty item including a spherical housing having an exterior appearance of a golf ball and which is approximately the same size as a conventional golf ball. A motion sensor is provided in the interior compartment of the golf ball which senses human intrusion into a specified area around the housing. A voice producing and emitting means is operatively connected to the motion sensor so that the voice producing and emitting means will emit a predetermined message when a human intrudes into the specified area around the housing. Preferably, a ground stake is secured to the golf ball for anchoring the golf ball.

12 Claims, 2 Drawing Sheets

GOLF BALL NOVELTY ITEM

SUMMARY OF THE INVENTION

A golf ball novelty item comprising a spherical housing having an exterior appearance of a golf ball. The housing also includes an interior compartment containing a motion sensor and a voice producing and emitting means. The motion sensor senses human intrusion into a specified area around the housing. When a human intrudes into the specified area around the housing, the voice producing and emitting means will emit a predetermined message to the intruder such as "Don't even think about it," "I do not belong to you," "Get out of my sight," etc.

It is therefore a principal object of the invention to provide a golf ball novelty item.

A further object of the invention is to provide a golf ball novelty item including means for anchoring the same into the ground.

A further object of the invention is to provide a golf ball novelty item which includes a motion sensor which senses human intrusion into a specified area around the golf ball and which then emits a voice containing a predetermined message.

A further object of the invention is to provide a device of the type described wherein the motion sensor and voice producing and emitting means are battery powered.

Still another object of the invention is to provide a golf ball novelty item wherein a ground stake is operatively secured to the golf ball.

Still another object of the invention is to provide a golf ball novelty item wherein the item is approximately the same size as a conventional golf ball and which has an exterior appearance of a golf ball.

These and other objects of the invention will be apparent to those skilled in the art.

DESCRIPTION OF THE PREFERRED EMBODIMENT

Figure 1:
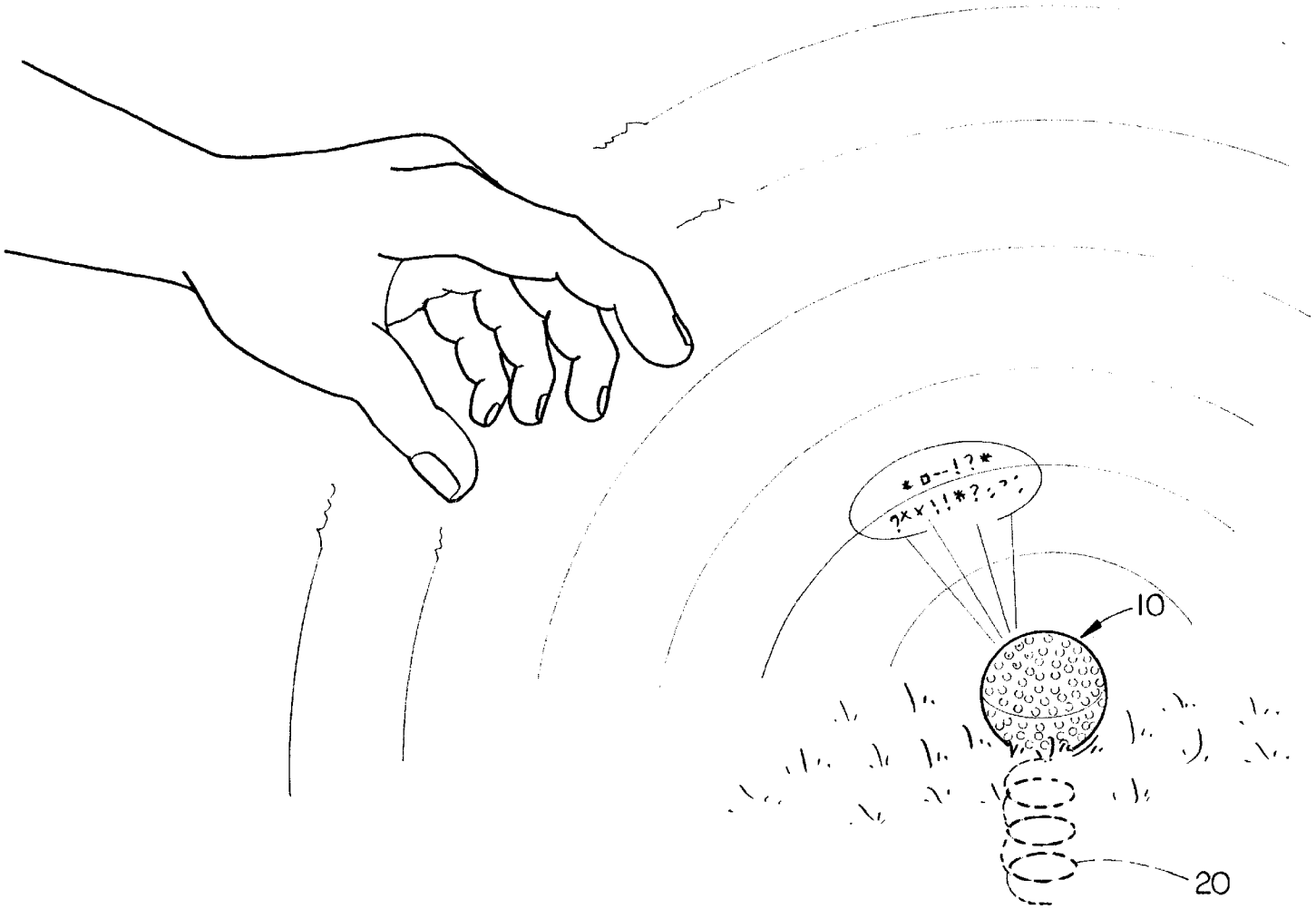
FIG. 1 is a perspective view of the golf ball novelty item of this invention illustrating the golf ball emitting a prerecorded message when a human intrudes into a specified area around the golf ball.
Figure 2:
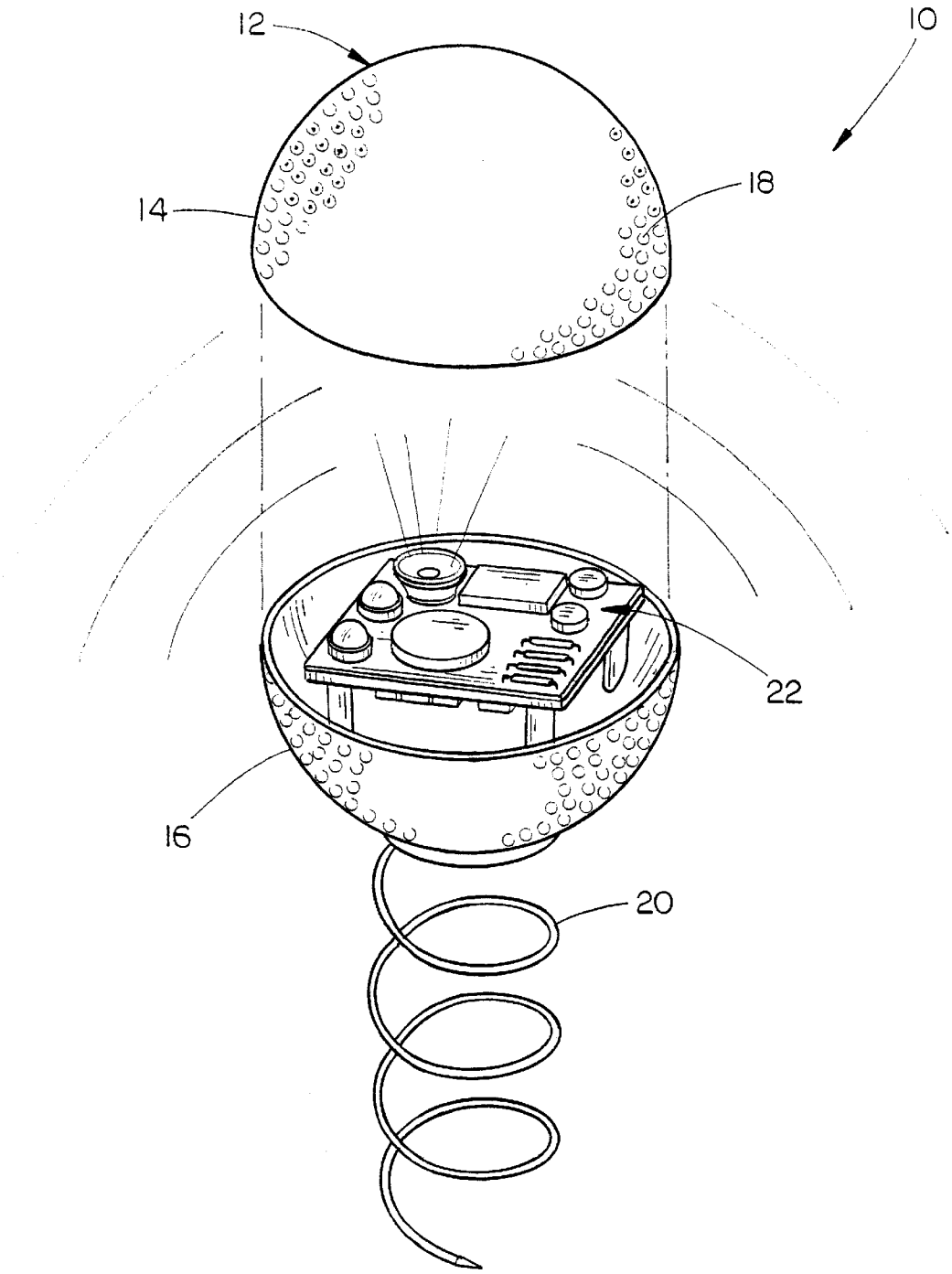
FIG. 2 is an exploded perspective view of the golf ball novelty item of this invention illustrating the internal circuitry and the ground stake of the invention.

The numeral 10 refers to the golf ball novelty item of this invention including a housing 12 comprised of housing members 14 and 16. Housing 12 is approximately the same size as a conventional golf ball and is dimpled at 18 to closely resemble a golf ball. A helical ground stake 20 is secured to housing member 16 and extends downwardly therefrom so that the golf ball 10 may be anchored into the ground.

The numeral 22 refers to electronic circuitry which is contained in the interior of the golf ball 10 and which includes a conventional motion sensor as well as a voice producing and emitting means which is activated when a human intrudes into the specified area around the golf ball 10. The voice producing and emitting means is programmed to emit prerecorded messages such as "Don't even think about it," "I do not belong to you," "Get out of my sight," etc. The motion sensor of this invention is conventional in design as stated and may be such as that described in U.S. Pat. No. 6,016,100 or U.S. Pat. No. 5,322,717. The voice producing and emitting means is also conventional in design and may be designed such as that described in U.S. Pat. Nos. 4,702,140 or 5,886,631.

The homeowner living adjacent a golf course places the golf ball 10 in the homeowner's yard and anchors the same through the use of the ground stake 20. The battery powered electronic circuitry senses the intrusion of a human within a specified area of the golf ball and then emits the prerecorded message as described above. The sound coming from the golf ball, as the intruder attempts to recover the same, provides many hours of entertainment for the homeowner who will normally be observing the same from a concealed location.

Thus it can be seen that the invention accomplishes at least all of its stated objectives.

I claim:

1. A golf ball novelty item, comprising:

a spherical housing having an exterior appearance of a golf ball and an interior compartment;

a motion sensor in said interior compartment which senses human intrusion into a specified area around said housing;

a voice producing and emitting means operatively connected to said motion sensor whereby said voice producing and emitting means will emit a predetermined message when a human intrudes into the specified area around said housing.

2. The item of claim 1 wherein said motion sensor and voice producing and emitting means are battery powered.

3. The item of claim 1 further including means for anchoring the housing to the ground.

4. The item of claim 1 wherein a ground stake is operatively secured to said housing.

5. The item of claim 4 wherein said ground stake is helical-shaped.

6. The item of claim 1 wherein said housing is approximately the same size as a conventional golf ball.

7. A golf ball novelty item, comprising:

a housing having an exterior appearance of a golf ball and an interior compartment;

a sensor in said interior compartment which senses human intrusion into a specified area around said housing;

sound producing means operatively connected to said sensor whereby said sound producing means will emit a predetermined sound when a human intrudes into the specified area around said housing.

8. The item of claim 7 wherein said sensor and sound producing means are battery powered.

9. The item of claim 7 further including means for anchoring the housing to the ground.

10. The item of claim 7 wherein a ground stake is operatively secured to said housing.

11. The item of claim 10 wherein said ground stake is helical-shaped.

12. The item of claim 7 wherein said housing is approximately the same size as a conventional golf ball.

* * * * *